United States Patent [19]

Pennington

[11] 4,043,378

[45] Aug. 23, 1977

[54] METHOD FOR FORMING CASTING MOLDS

[75] Inventor: Reginald Alfred Pennington, Norton Shores, Mich.

[73] Assignee: Westran Corporation, Muskegon, Mich.

[21] Appl. No.: 684,874

[22] Filed: May 10, 1976

[51] Int. Cl.[2] ..... B22C 1/22; B22C 9/08

[52] U.S. Cl. ..... 164/17; 164/21; 164/23; 164/43; 164/244; 164/359; 164/361

[58] Field of Search ..... 164/17, 23, 43, 44, 164/45, 162, 244, 359, 360, 361, 21

[56] References Cited

U.S. PATENT DOCUMENTS

| | | | |
|---|---|---|---|
| 2,654,925 | 10/1953 | Ensign et al. | 164/244 X |
| 2,691,196 | 10/1954 | Banister | 164/43 X |
| 2,797,457 | 7/1957 | Kramer | 164/43 X |
| 2,845,669 | 8/1958 | Hackett et al. | 164/361 X |
| 3,478,815 | 11/1969 | Worthington | 164/361 |
| 3,598,167 | 8/1971 | Snyderman | 164/361 X |
| 3,614,980 | 10/1971 | Lander | 164/244 X |
| 3,835,913 | 9/1974 | Vandemark et al. | 164/244 X |

*Primary Examiner*—Ronald J. Shore

*Attorney, Agent, or Firm*—Gifford, Chandler, Sheridan & Sprinkle

[57] ABSTRACT

An improved method of forming a shell mold for casting having a shrink bob is provided. A tubular frustoconical shrink bob, or riser, is first formed from sand and a plastic or resin binder such that both the apex and base of the riser are open. The riser is then inverted and positioned on a casting pattern with the apex of the riser abutting against the casting pattern. The entire pattern is then cast with a thermosetting material, such as sand and a binder, such that the thermosetting material bonds to both the pattern and the riser. After hardening, the thermosetting material with the attached riser forms a shell mold which is subsequently utilized in a foundry casting operation.

6 Claims, 7 Drawing Figures

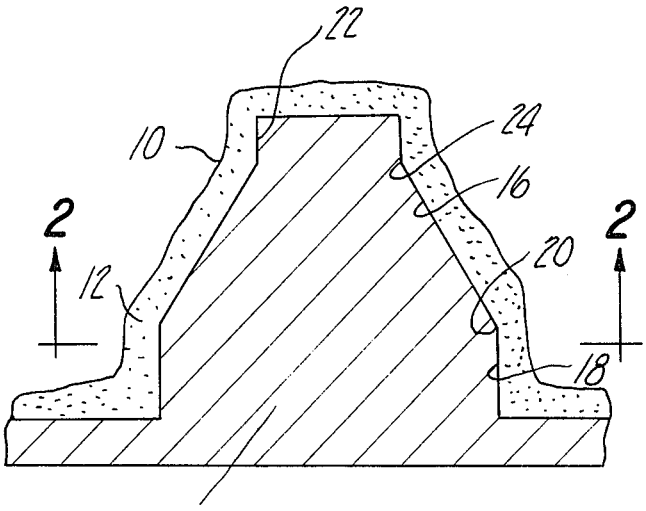
Fig-1
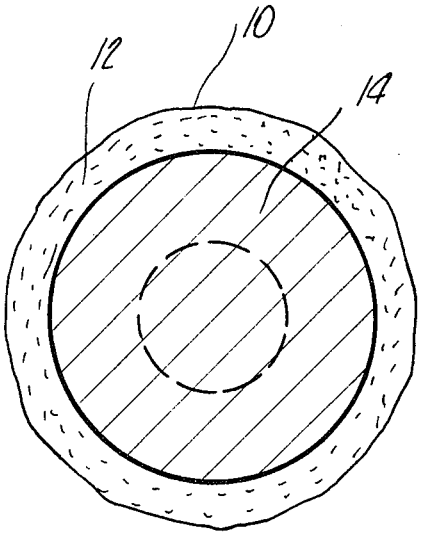
Fig-2
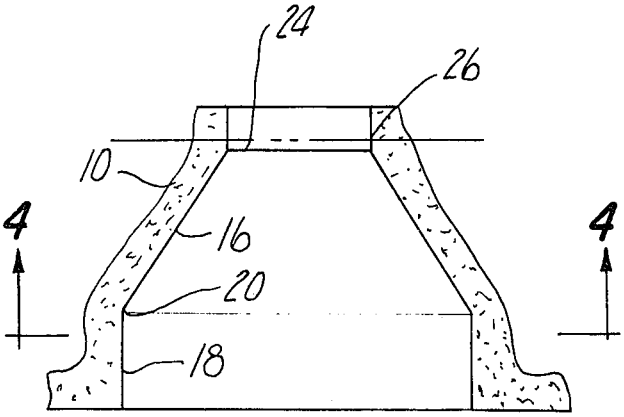
Fig-3
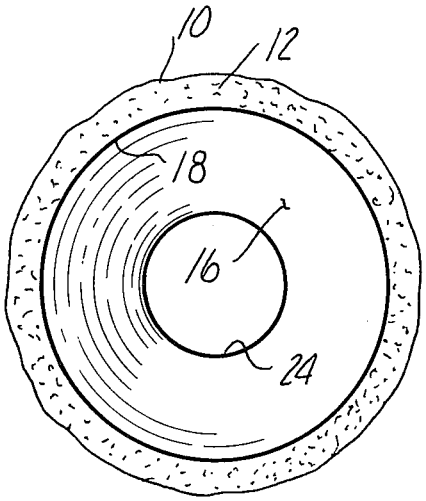
Fig-4
Fig-5
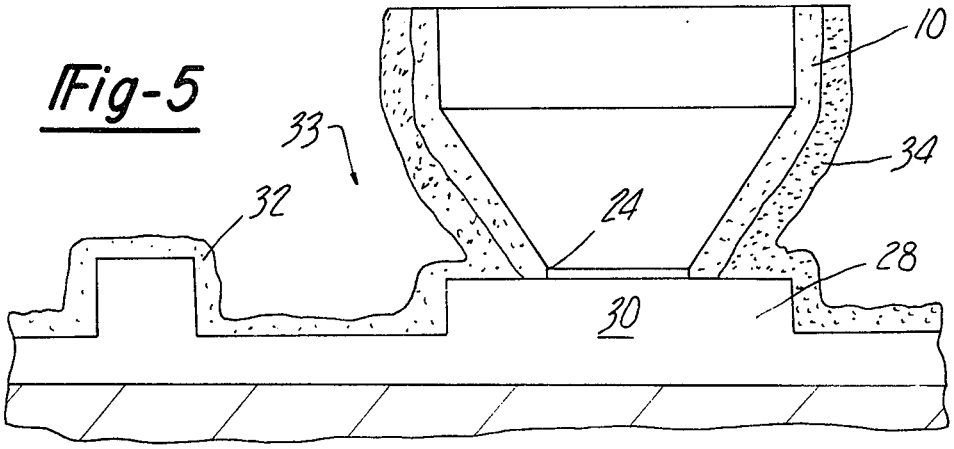

METHOD FOR FORMING CASTING MOLDS

BACKGROUND OF THE INVENTION

I. Field of the Invention

The present invention relates to a method for forming a shell mold for a foundry casting operation with an improved shrink bob portion.

II. Description of the Prior Art

Essentially the previously known shell molding processes use a thermosetting molding material to form rigid molds having high gas permeability, good surface smoothness and dimensional stability. The molding material, which is generally a dry mixture of silica or other refractory oxide sand and a minor amount of plastic or resin binder, is normally used in powdered form with no water being added.

The shell mold is prepared by applying the dry mixture of the molding material to a hot casting pattern for a relatively short period of time. A generally uniform layer of the molding material adheres to the pattern surfaces due to the melting resin which in turn bonds the sand together to accurately reproduce the details from the casting pattern. The casting pattern typically forms one-half of the shell mold so that by fixing together two halves of a shell mold, a complete casting mold is achieved. Molten metal is thereafter poured into the shell mold through a sprue to form a casting.

As is well known in the art, horizontally elongated or intricate casting patterns are prone to surface defects after the metal casting operation. These surface defects in the cast metal are not only undesirable but oftentimes result in the scrapping of the metal part.

In order to minimize surface defects during the metal casting operation, previously known shell molds have been provided with vertically extending shrink bob chambers or risers. The shrink bobs are filled with the molten casting metal during the casting operation so that each shrink bob forms a hydrostatic or pressure head which exerts a downward pressure upon the molten metal. This pressure head aids in feeding the molten casting metal to all portions in the shell mold and absorbs metal shrinkage which would otherwise occur without the shrink bob.

These previously known shrink bobs are necessarily conical or frusto-conical in shape with the base of the conical portion open to the casting chamber. This construction of the shrink bob is necessary since otherwise the shell mold could not be removed from the casting pattern after the mold had hardened onto the pattern. These previously known shrink bobs are thus inefficient in that the shrink bob must be vertically elongated in order to generate a sufficiently large hydrostatic pressure necessary to aid in feeding the molten casting metal. Moreover, due to the conical shape of the previously known shrink bobs the incremental increase in hydrostatic pressure decreases proportionately with the height of the shrink bob.

Removal of the shrink bob by machining is necessary for the casting to form a finished product. Since the base of the frusto-conical shrink bob is quite large, removal by machining is difficult and expensive.

SUMMARY OF THE INVENTION

The present invention overcomes the above mentioned metal casting problems by providing a method for constructing a shell mold with a tubular frusto-conical shrink bob but in which the apex, rather than the base, of the shrink bob is open to the casting chamber. Moreover, as will become hereinafter apparent, the shrink bob of the present invention may also be utilized as a sprue during the metal casting operation.

In brief the shell forming method of the present invention comprises the first step of forming a tubular frusto-conical shrink bob or riser, of a thermosetting molding material such as sand and a resin. Preferably the shrink bob is open both at its base and at its apex.

The shrink bob is then inverted and positioned on a casting pattern in a vertical position with the base of the shrink bob above the apex so that the apex abuts against the casting pattern.

Thereafter the casting pattern is molded with a thermosetting molding material which may be the same molding material as the shrink bob, so that the molding material adheres to and reproduces the casting pattern while simultaneously bonding with the shrink bob.

After the molding material has hardened, the material with the attached shrink bob is removed from the casting pattern and forms one-half of the casting shell for a subsequent metal casting operation.

BRIEF DESCRIPTION OF THE DRAWINGS

A better understanding of the present invention will be had upon reference to the following detailed description when read in conjunction with the accompanying drawing, wherein like reference characters refer to like parts throughout the several views and in which:

FIG. 1 is a side cross sectional view showing one step of the shell molding method of the present invention;

FIG. 2 is a cross sectional view taken substantially along line 2—2 in FIG. 1;

FIG. 3 is a cross sectional view showing another step of the shell molding of the present invention;

FIG. 4 is a cross sectional view taken substantially along line 4—4 in FIG. 3;

FIG. 5 is a cross sectional view showing a third step of the shell molding method of the present invention;

DETAILED DESCRIPTION OF THE PRESENT INVENTION

Figure 6:
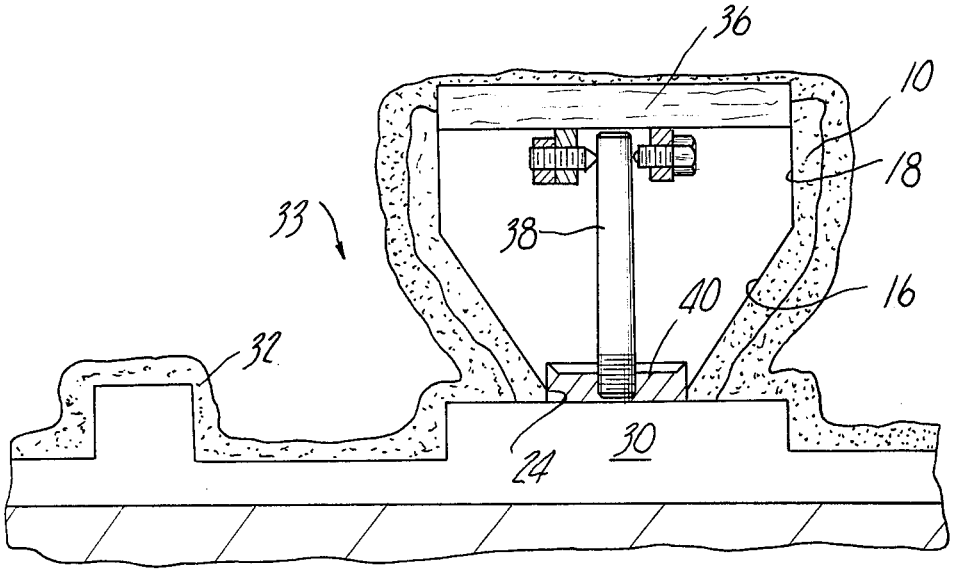
FIG. 6 is a cross sectional view of the shell molding of the present invention similar to FIG. 5 but showing a modification thereof.

With reference to FIGS. 1 and 2, a shrink bob 10 is first constructed by applying a thermosetting molding material 12 to a casting pattern 14. The molding material 12 comprises any conventional material utilized for constructing shell molds such as, for example, a thermosetting plastic or resin utilized as a binder for sand grains, or the like. In the conventional fashion, the casting pattern 14 is preheated to a predetermined temperature before the molding material 12 is applied to the pattern 14. The heat from the pattern 14 melts the binder within the material 12 so that as the material 12 cools and hardens, the internal walls of the shrink bob 10 accurately reproduce the shape of the casting pattern 14.

Still referring to FIGS. 1 and 2, the shrink bob 10 comprises a frusto-conical wall portion 16 and a cylindrical wall portion 18 which extends downwardly from the base 20 of the frusto-conical wall portion 16. In addition a small cylindrical wall section 22 extends upwardly from the apex 24 of the frusto-conical wall portion 16.

Referring now to FIGS. 3 and 4, the shrink bob 10 is thereshown removed from the casting pattern 14. In addition the upper portion of the shrink bob 10 is removed by grinding or sanding. Thus both the apex 24 and the base 20 of the frusto-conical wall portion 16 are open so that the shrink bob 10 is tubular.

Referring now to FIG. 5, the shrink bob 10 is inverted and positioned on a second casting pattern 28 so that the apex 24 of the wall portion 16 is open to the subsequent casting chamber 30. The second casting pattern 28 forms the shell mold pattern for a subsequent metal casting operation as will become shortly apparent.

Still referring to FIG. 5, with the shrink bob 10 properly positioned on the casting pattern 28, the pattern 28 is heated and covered with a thermosetting molding material 32 which may be the same as the molding material 12. A portion 34 of the molding material 32 also covers the outer periphery of the shrink bob 10 and, due to the heat from the casting pattern 28, a portion of the resin in the shrink bob 10 melts and bonds with the thermosetting molding material 32. In this manner as the molding material 32 cools and sets the shrink bob 10 is rigidly attached to and bonded with the material 32 thus forming a shell mold 33 for a metal casting operation. The shell mold 33 is then curved by subjecting the shell mold 33 to a relatively elevated temperature.

Preferably the casting pattern 14 (FIG. 2) is adjacent to but separate from the casting pattern 28 (FIG. 5) so that both patterns 14 and 28 are simultaneously molded. This permits the construction of a shrink bob 10 for use with the next shell mold 33 and eliminates the need for separately constructing the shrink bob 10 from the shell mold 33.

A modification of the step shown in FIG. 5 is illustrated in FIG. 6 in which a cap 36 sealingly engages the upper end of the cylindrical wall 18 of the shrink bob 10. The cap 36 is connected by a rod 38 to a plug 40 sealingly covers the openings at the apex 24 of the wall portion 16. The cap 36 and plug 40 are inserted into the interior of the shrink bob 10 prior to applying the molding material 32 to the casting pattern 28 and prevent the molding material 32 from entering into the interior of the shrink bob 10. After the molding material 32 has cooled and hardened on the pattern 28 and the shrink bob 10, the cap 36 the attached plug 40 is removed from the shrink bob 10. The shrink bob 10 can then be grouond smoothly if necessary and then used in the manner described above.

Figure 7:
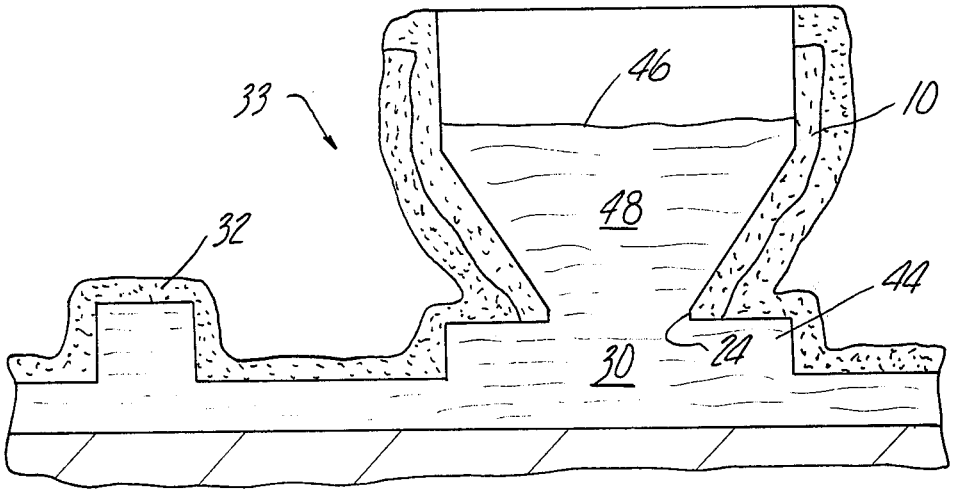
FIG. 7 is a cross sectional view showing a metal casting operation utilizing a shell mold constructed according to the method of the present invention.

With reference now to FIG. 7 the shell mold 33 with the shrink bob 10 is removed from the pattern 28 and positioned for a metal casting operation. Molten metal is introduced into the casting chamber 30 and assumes the configuration of the internal walls of the shell mold 33. In order to insure proper feeding of the molen metal to intricate areas of the shell mold 33, such as an area 44, excess molten metal is poured into the casting chamber 30 so that molten metal rises up into the shrink bob 10 to a liquid level indicated at 46.

The hydrostatic pressure or head pressure from the molten metal within the shrink bob 10 insures proper feeding of the molten metal to the area 44. Since the surface area of the metal at the level 46 within the shrink bob 10 is must greater than the area at the apex 24 of the shrink bob 10, a relatively great amount of hydrostatic pressure is exerted on the molten metal while utilizing a relatively small amount of excess metal 48.

When the molten metal has hardened, the shell mold 33 is broken away and the excess metal 48 formally entrapped with the shrink bob 10 is cut away and returned to scrap.

It can thus be seen that the shell mold 33 of the present invention is greatly advantageous over the previously known shell molds in that the relatively small shrink bob 10 of the present invention functions more efficiently than previously known shrink bobs. Moreover, the amount of excess metal 48 necessary to insure proper feeding of the metal within the casting chamber 30 is greatly reduced which accordingly reduces metal wastage from the casting operation.

In addition, the shrink bob 10 may also be used as a sprue since the upper end of the shrink bob 10 is open. Thus molten metal may be poured through the shrink bob 10 and into the casting chamber 30 when desired.

Having thus described my invention, many modifications thereto will become apparent to those skilled in the art to which it pertains without deviating from the spirit of the invention as defined by the scope of the appended claims.

I claim:

1. A method of forming a shell mold comprising the steps of:

forming a tubular frusto-conical shrink bob of a first thermosetting material such that said shrink bob is open at its base and apex.

positioning the apex of said shrink bob onto a shell mold casting pattern, and casting said shell mold casting pattern with a second thermosetting material whereby said second thermosetting material encases at least a portion of said shrink bob and forms the shell mold with the shrink bob joined thereto.

2. The method as defined in claim 1 wherein said first and second thermosetting materials are substantially the same material.

3. The method as defined in claim 1 wherein said step of forming said shrink bob further comprises the steps of:

casting said first a thermosetting molding material onto a frusto-conical casting pattern wherein the apex of said frusto-conical casting pattern is vertically above the base, and removing a portion of said molding material from the apex of said shrink bob whereby said shrink bob is open on each end.

4. The method as defined in claim 3 wherein said step of removing said portion further comprises the step of coaxially grinding the apex of said shrink bob.

5. The method as defined in claim 3 and further comprising the step of inserting a plug which sealingly engages both the base and apex of said shrink bob into said shrink bob prior to casting said shell mold casting pattern.

6. The method as defined in claim 1 and in which said shrink bob and said shell mold are simultaneously formed as separable units and the shrink bob is removed therefrom and inserted onto the shell mold casting pattern of a subsequent shell mold.

* * * * *

UNITED STATES PATENT AND TRADEMARK OFFICE

CERTIFICATE OF CORRECTION

PATENT NO. : 4,043,378

DATED : August 23, 1977

INVENTOR(S) : Reginald Alfred Pennington

It is certified that error appears in the above-identified patent and that said Letters Patent are hereby corrected as shown below:

Col. 3, line 40, before "sealingly", insert --which--;

line 40, delete "openings", insert --opening--;

line 47, after "36", insert --with--;

line 49, delete "grouond", insert --ground--;

line 65, delete "must", insert --much--.

Col. 4, line 45, delete "a".

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*